US007819391B2

(12) United States Patent
Glover

(10) Patent No.: US 7,819,391 B2
(45) Date of Patent: Oct. 26, 2010

(54) CARBURETTOR

(75) Inventor: Stephen Glover, Comber (GB)

(73) Assignee: Ricardo UK Limted, West Sussex (GB)

( * ) Notice: Subject to any disclaimer, the term of this patent is extended or adjusted under 35 U.S.C. 154(b) by 204 days.

(21) Appl. No.: 11/791,631

(22) PCT Filed: Nov. 25, 2005

(86) PCT No.: PCT/GB2005/004530

§ 371 (c)(1),
(2), (4) Date: Jan. 30, 2008

(87) PCT Pub. No.: WO2006/056789

PCT Pub. Date: Jun. 1, 2006

(65) Prior Publication Data

US 2009/0020895 A1 Jan. 22, 2009

(30) Foreign Application Priority Data

Nov. 26, 2004 (GB) ..... 0426027.9

(51) Int. Cl.
*F02M 23/03* (2006.01)

(52) U.S. Cl. ..... 261/23.2; 123/73 PP; 261/23.3; 261/63; 261/DIG. 1

(58) Field of Classification Search ..... 261/23.2, 261/23.3, 45, 54, 63, DIG. 1; 123/73 PP
See application file for complete search history.

(56) References Cited

U.S. PATENT DOCUMENTS 4,333,429 A * 6/1982 Iiyama et al. ..... 123/274
6,101,991 A 8/2000 Glover
6,334,606 B1 * 1/2002 Tobinai et al. ..... 261/23.3
6,889,637 B2 * 5/2005 Rosskamp ..... 123/73 PP
7,011,298 B2 * 3/2006 Gerhardy et al. ..... 261/46
7,013,851 B2 * 3/2006 Prager ..... 123/73 PP
7,090,204 B2 * 8/2006 Zwimpfer et al. ..... 261/46
7,258,327 B2 * 8/2007 Prager ..... 261/46
7,261,281 B2 * 8/2007 Raffenberg ..... 261/44.8

(Continued)

FOREIGN PATENT DOCUMENTS

EP 1 035 312 A 9/2000

(Continued)

OTHER PUBLICATIONS

International Search Report for PCT/GB2005/004530 mailed Jun. 19, 2006 (4 pages).

*Primary Examiner*—Richard L Chiesa
(74) *Attorney, Agent, or Firm*—Osha Liang LLP

(57) ABSTRACT

A carburetor for a two stroke engine includes a flow duct comprising rich and lean flow passages separated by a partition, at least one fuel jet communicating with the rich passage, the partition including an aperture towards which the fuel jet is directed, and a substantially planar butterfly valve being received in the aperture so as to be pivotable between a first position, in which the flow duct is substantially closed and the aperture is substantially open, and a second position, in which the flow duct is substantially open and the aperture is substantially closed, the flow duct further including a venturi section located substantially upstream of the aperture, and wherein the venturi section extends only partially around a perimeter of the flow duct.

17 Claims, 1 Drawing Sheet

U.S. PATENT DOCUMENTS

| | | | | |
|---|---|---|---|---|
| 7,407,153 | B2 * | 8/2008 | Glover | 261/46 |
| 2004/0012102 | A1 | 1/2004 | Gerhardy | |
| 2004/0051186 | A1 | 3/2004 | Gerhardy et al. | |
| 2005/0073062 | A1 * | 4/2005 | Zwimpfer et al. | 261/65 |
| 2005/0120985 | A1 * | 6/2005 | Rosskamp | 123/73 PP |
| 2005/0188952 | A1 * | 9/2005 | Prager | 123/337 |
| 2006/0131763 | A1 * | 6/2006 | Raffenberg | 261/43 |
| 2006/0163755 | A1 * | 7/2006 | Prager | 261/46 |
| 2007/0132115 | A1 * | 6/2007 | Glover | 261/40 |
| 2009/0013963 | A1 * | 1/2009 | Eberhardt et al. | 123/337 |

FOREIGN PATENT DOCUMENTS

| | | |
|---|---|---|
| EP | 1 078 151 B1 | 12/2002 |

* cited by examiner

CARBURETTOR

The present invention relates to a carburettor, and more particularly to a carburettor of the type disclosed in EP 1078151 B1, the content of which is incorporated herein by reference.

A problem faced by current engine designers is the increasing need for reduced engine emissions. This challenge is increasingly difficult as the number of engines in use continues to climb and as governments continually introduce more stringent emissions legislation. In this situation, small improvements in the emissions level of an engine can be of significant importance.

Small two-stroke engines, particularly those for use with hand-held products, are facing ever-stricter emissions control legislation and durability requirements. Yet further legislation is expected in the USA in the near future and this legislation will be particularly severe for such small engines and is expected to include limits not only on unburned hydrocarbons (HC) and carbon monoxide (CO) but also on particulate emissions.

Two stroke engines are highly desirable due to their characteristics of low weight, small package size, high power to weight ratio and simplicity of manufacture, and low cost in comparison to four stroke engines of the same power output.

It is known to reduce the exhaust emissions of a two-stroke engine by the use of stratified charge techniques, in which an inlet duct of the engine is divided into two separate passages, referred to as a substantially rich passage and a substantially lean passage. Emissions from a stratified charge two stroke engine may be reduced further using a carburettor such as that disclosed in EP 1078151 B1. The carburettor is arranged to direct a rich fuel/air mixture into the rich passage and a weak mixture or substantially pure air into the lean passage at high engine load, when the carburettor butterfly valve is substantially fully open, but to direct a substantially equally rich mixture into both the rich and lean passages at low engine load, when the butterfly valve is substantially closed.

The engine with which the carburettor is used is of the crankcase scavenged type and is arranged so that the combustion space is filled with a stratified charge, that is to say a charge whose fuel/air ratio varies over the volume of the combustion space, at high engine load but with a substantially homogeneous charge, that is to say a charge whose fuel/air ratio is substantially the same over the volume of the combustion space, at low engine load. This is achieved in the engine disclosed in EP 1078151 B1 by dividing the interior of the crankcase into two or more separate volumes, one of which, referred to as the rich volume, communicates with the rich passage, and the other of which, referred to as the lean volume, communicates with the lean passage. The rich and lean volumes communicate with the combustion space at different positions.

Under high engine load, the combustion space is scavenged primarily with substantially pure air from the lean volume. The remaining pure air and the rich fuel/air mixture from the rich volume do not mix thoroughly and the charge is stratified. Under low load, there is a similar relatively weak fuel/air mixture in both the rich and lean volumes and the charge in the combustion space is therefore substantially homogeneous.

It is desirable that the method used to reduce emissions should not adversely affect or reduce performance. The engine power and torque required to operate such devices as chain saws, concrete saws, electrical generators etc. should preferably not be compromised by the emissions reduction equipment.

It has been found that carburettors as disclosed in EP1078151 B1 may be improved in a way that does not reduce performance at idle or during progression to full load operation.

The invention is as set out in the independent claims. Preferred features are set out in the dependent claims.

An exemplary embodiment of the present invention will now be explained in more detail by the following non-limiting description and with reference to the accompanying drawings, in which.

In overview, the carburettor of the invention provides improved air and fuel management in an air/fuel system known in the art as a 'main venturi'.

Figure 1:
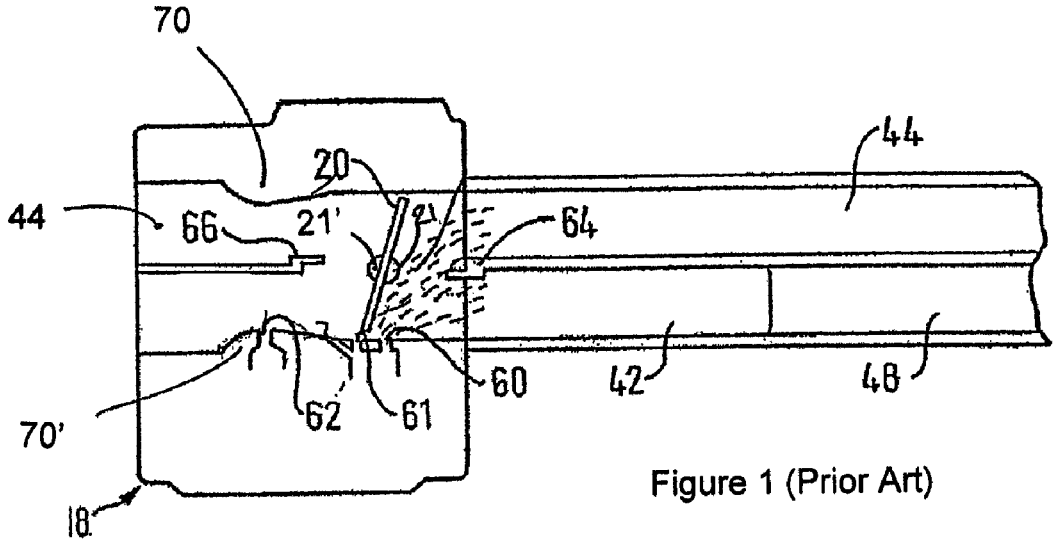
Figure 1 (Prior Art)
FIG. 1 is a carburettor as found in the invention described in EP 1078151 B1.

A known split carburettor 18 shown in FIG. 1 is a fixed choke carburettor and includes twin passages consisting of an upper lean passage 44 and a lower rich passage 42. In this carburettor a throttle valve 20 is constructed and operated, and the rich and lean passages are so arranged, that under low load or idling conditions, fuel is introduced from a fuel jet 62 into both the rich 42 and the lean 44 passages as air passes through a venturi 70, 70' and therefore into rich and lean volumes of the engine (not shown). However, under high load conditions, substantially only air is delivered through the upper passage 44, and a mixture of fuel and air is introduced into the rich passage 42.

The carburettor of FIG. 1 has been found to perform as described in EP 1078151 B1. However, some highly rated small two stroke engines that operate at high speed and load have been found to require significantly more air to be delivered through the lean channel 44. In order to achieve the desired emissions reduction, it has been found that up to 60% or even 70% or more of the total engine air flow volume should be supplied through the lean passage or channel 44 rather than through the predominantly rich passage or channel 42.

As is normal in fixed choke or non-variable choke carburettors, the venturi 70, 70' is a continuous or fully circular annular restriction in the main choke or barrel of the carburettor. It is this restriction, due to the law of conservation of energy, which results in the speeding up of the air flow and a corresponding reduction in air pressure, which draws the fuel from the main jet 62. Also as normally found in carburettors, the throttle shaft or spindle 21, 21' that supports the throttle valve or plate 20 is split to allow the insertion of the throttle plate 20. The throttle plate 20 is secured within the slotted spindle by one or two screws (not shown), which pass through the spindle and are subsequently tightened to lock the throttle plate 20 between the two halves of the spindle 21 and 21'.

Figure 2:
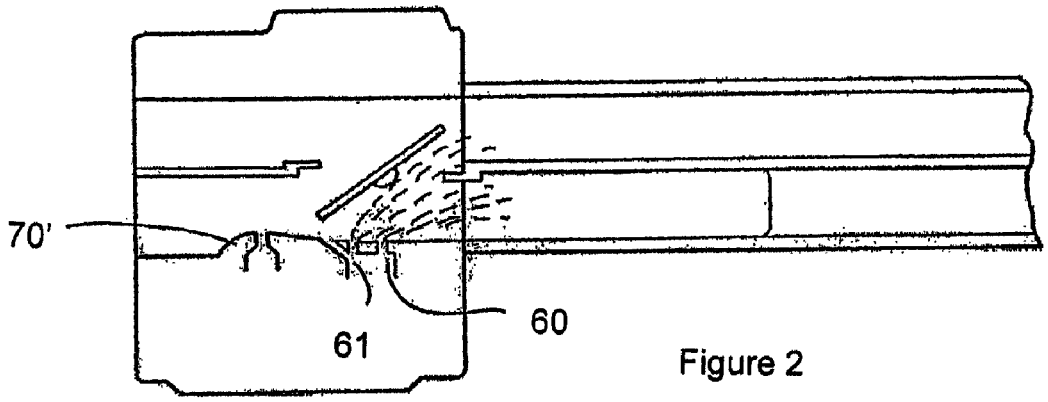
FIG. 2 is a carburettor in accordance with the present invention, shown during progression from idle to full or high load operation.
Figure 3:
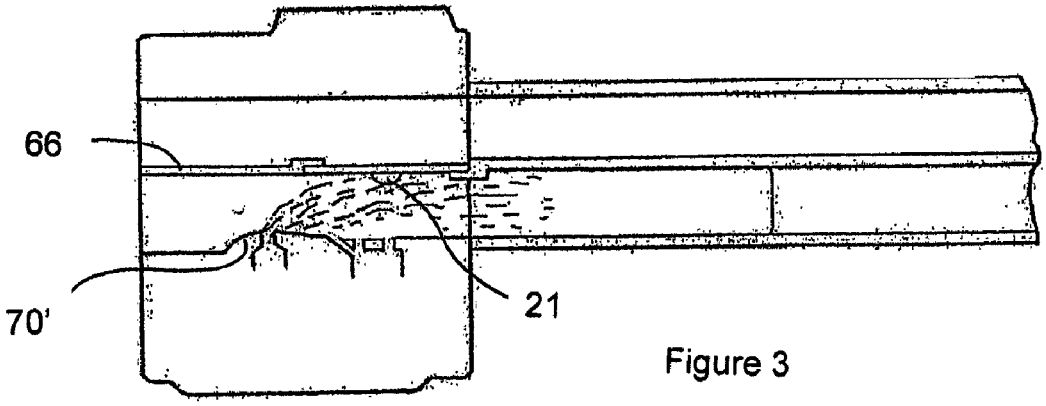
FIG. 3 is a carburettor in accordance with the present invention, shown at high load operation.

FIGS. 2 and 3 show a carburettor according to the present invention in which the upper or predominantly lean passage 44 of the split carburettor does not have a venturi section or restriction, but instead has a substantially uniform cross section through the carburettor, and the upper or lean passage 44 is further improved by the removal of half of the throttle shaft 21'. FIG. 2 shows the carburettor at a stage of progression from idle to low load operation. During this intermediate stage, fuel is supplied from an idle orifice 60. As the throttle is opened, progression holes 61 will gradually supply more fuel than the idle orifice 60 until substantially all the fuel for this low load stage will be supplied from the progression holes 61. During progression, the main venturi is not active and the depression created by the restriction of the throttle 20 provides the depression required.

Referring now to FIG. 3, as the operator demands more power, the progression system can no longer supply a significant volume of fuel and the main throttle plate 20 is opened yet further. Due to the action of the venturi 70' speeding up the airflow and reducing atmospheric pressure, fuel is now preferentially drawn from a main jet 62 located approximately at the throat of the venturi. It can be seen that the venturi, now only fitted into the lower (as seen in FIG. 3) or predominantly rich passage, can affect a speed increase and pressure drop due to the close proximity of a splitter plate 66.

Furthermore, because of the removal of the upper half of the throttle spindle 21', at substantially full throttle operation when the throttle plate 20 is open at its widest position, an increased volume of air will flow through passage 44, further improving the stratified charging of the engine without compromising the idle, progression or full power operation of the carburettor.

The carburettor of the invention thus improves the air and fuel management of a two stroke engine. In maximising the airflow through the main venturi and barrel or bore of the carburettor, it is possible for an engine to be fully compliant with emissions regulations whilst maintaining the quality of the idle and progression.

It is also of significant importance that in manufacture of the carburettor, the carburettor external dimensions are predetermined or fixed with regard to the packaging volume or space available. This is commonly described in the art as the box or cube volume of the carburettor. This feature of the carburettor is particularly important in small handheld equipment in which space is at a premium. Furthermore, it is common for many carburettors to be manufactured from the same die; the die used to produce the blank casting prior to machining and finishing. Thus, a further advantage of the carburettor of the present invention is that it addresses the need for a greater flow rate of air through the lean passage 44 without a substantial re-design in which the external dimensions of the carburettor are altered.

Various modifications may be made to the embodiment described without departing from the scope of the invention as defined by the claims.

The invention claimed is:

1. A carburettor for a two stroke engine comprising a flow duct comprising rich and lean flow passages separated by a partition, at least one fuel jet communicating with the rich passage, the partition including an aperture towards which the fuel jet is directed, and a substantially planar butterfly valve being received in the aperture so as to be pivotable between a first position, in which the flow duct is substantially closed and the aperture is substantially open, and a second position, in which the flow duct is substantially open and the aperture is substantially closed, the flow duct further comprising a venturi section located substantially upstream of the aperture, wherein the venturi section extends only partially around a part of a perimeter of the flow duct, wherein the substantially planar butterfly valve is disposed on a D-shaped spindle for pivotal movement thereon, and wherein the D-shaped spindle does not extend above a line projected along a lowermost surface of the substantially planar butterfly valve.

2. The carburettor as claimed in claim 1, in which the flow duct has a substantially circular cross section and in which the venturi extends radially inwards from a portion of the circumference of the flow duct.

3. The carburettor as claimed in claim 1 in which the venturi is wholly or predominantly contained within the rich passage.

4. The carburettor as claimed in claim 3 in which at least a portion of the venturi within the lean passage is removed.

5. The carburettor as claimed in claim 1 in which the carburettor is a fixed choke carburettor.

6. The carburettor as claimed in claim 2 in which the venturi is wholly or predominantly contained within the rich passage.

7. The carburettor as claimed in claim 6 in which at least a portion of the venturi within the lean passage is removed.

8. A fixed choke carburettor arranged to supply fuel to a two stroke engine, the carburettor comprising an inlet duct, a throttle valve arranged to throttle a flow of air through the inlet duct, the inlet duct being divided over at least part of its length into a rich passage and a lean passage which are arranged to communicate with a rich volume and a lean volume respectively of the engine, the carburettor and throttle valve being adapted to supply, under high load operation, substantially all fuel into the rich passage, and to supply fuel into both the rich and lean passages under low load operation, a venturi section extending radially inwards in the inlet duct for less than a full circumference of the duct, wherein the throttle valve is disposed on a D-shaped spindle for pivotal movement thereon, and wherein the D-shaped spindle does not extend above a line projected along a lowermost surface of the throttle valve.

9. The carburettor as claimed in claim 8 including at least one fuel jet communicating with the rich passage for supply of fuel to the carburettor.

10. The carburettor as claimed in claim 8 in which the venturi is wholly or predominantly contained within the rich passage.

11. The carburettor as claimed in claim 10 in which at least a portion of the venturi within the lean passage is removed.

12. A carburettor for a two stroke engine comprising a flow duct comprising rich and lean flow passages separated by a partition, at least one fuel jet communicating with the rich passage, the partition including an aperture towards which the fuel jet is directed, and a substantially planar butterfly valve being received in the aperture so as to be pivotable between a first position, in which the flow duct is substantially closed and the aperture is substantially open, and a second position, in which the flow duct is substantially open and the aperture is substantially closed, the planar butterfly valve being disposed on a D-shaped spindle for pivotal movement thereon, the spindle and planar butterfly valve being arranged such that in the second position the spindle is wholly contained within the rich passage, wherein the spindle does not extend above a line projected along a lowermost surface of the planar butterfly valve.

13. The carburettor as claimed in claim 12 in which the spindle is wholly contained within the rich channel.

14. The carburettor as claimed in claim 12 in which the carburettor is a fixed choke carburettor.

15. A fixed choke carburettor arranged to supply fuel to a two stroke engine, the carburettor comprising an inlet duct, a throttle valve arranged to throttle a flow of air through the inlet duct, the inlet duct being divided over at least part of its length into a rich passage and a lean passage which are arranged to communicate with a rich volume and a lean volume respectively of the engine, the carburettor and throttle valve being adapted to supply, under high load operation, substantially all fuel into the rich passage, and to supply fuel into both the rich and lean passages under low load operation, the throttle valve being disposed on a D-shaped spindle for pivotal movement thereon, the spindle and throttle valve being arranged such that under high load operation at substantially full throttle, the spindle is wholly contained within the predominantly rich passage, wherein the spindle does not extend above a line projected along a lower most surface of the throttle valve.

16. The carburettor as claimed in claim 15 in which the spindle is wholly contained within the rich channel.

17. The carburettor as claimed in claim 15 including at least one fuel jet communicating with the rich passage for supply of fuel to the carburettor.

* * * * *